US006087568A

United States Patent [19]

Seal

[11] Patent Number: 6,087,568

[45] Date of Patent: Jul. 11, 2000

[54] ACOUSTICALLY TAILORED, COMPOSITE MATERIAL STRINGED INSTRUMENT

[76] Inventor: Ellis C. Seal, 530 Bismark St., Bay St. Louis, Miss. 39250

[21] Appl. No.: 09/200,587

[22] Filed: Nov. 27, 1998

[51] Int. Cl.[7] ..... G10C 3/06

[52] U.S. Cl. ..... 84/193; 84/294

[58] Field of Search ..... 84/192, 193, 291, 84/294

[56] References Cited

U.S. PATENT DOCUMENTS 5,952,592 9/1999 Teel ..... 84/291
5,955,688 9/1999 Cook ..... 84/291

*Primary Examiner*—Jeffrey Donels
*Attorney, Agent, or Firm*—C. Michael Zimmerman

[57] ABSTRACT

A guitar is described which is essentially made up of a plurality of plies of composite laminates individually selected and arranged together to provide desired sounds.

15 Claims, 3 Drawing Sheets

FIG. 2
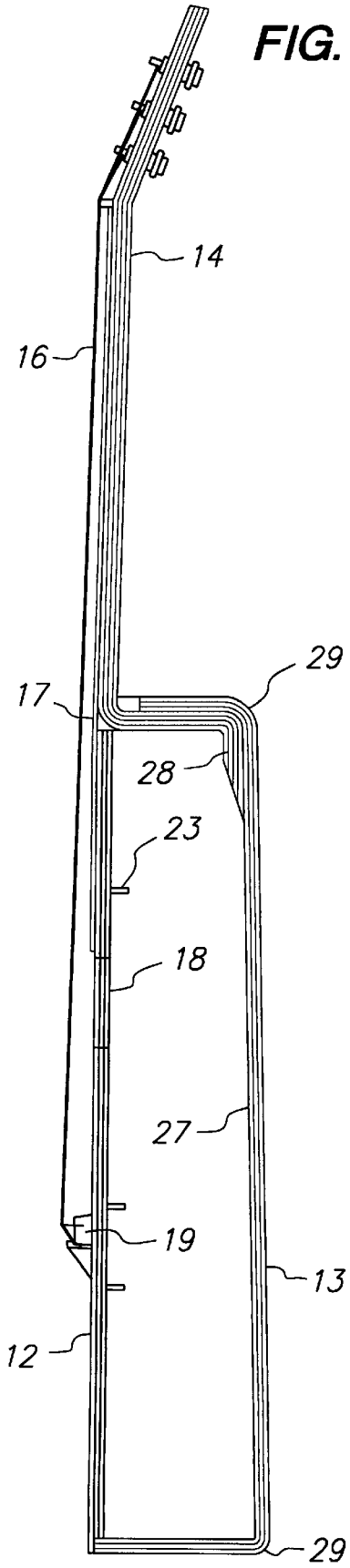
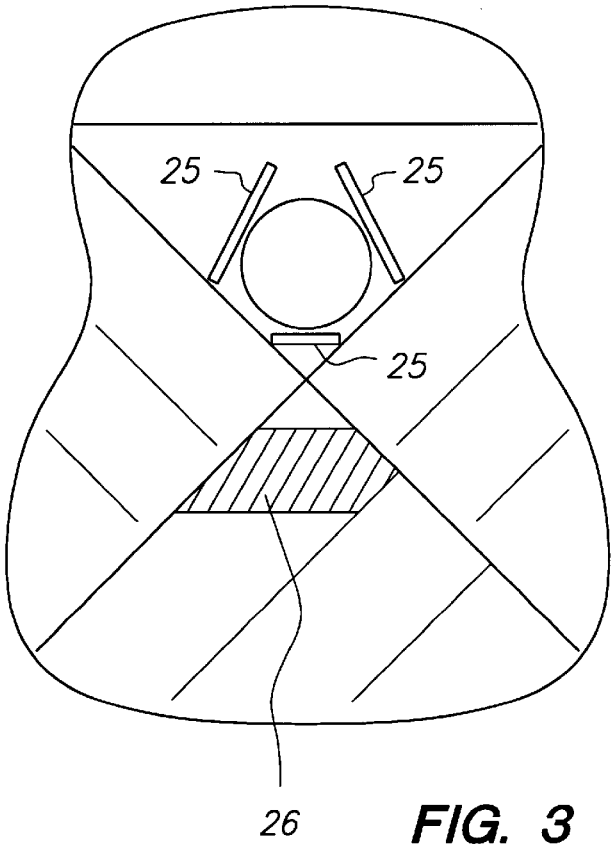
FIG. 3
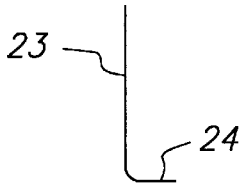
FIG. 4

ACOUSTICALLY TAILORED, COMPOSITE MATERIAL STRINGED INSTRUMENT

BACKGROUND OF THE INVENTION

The present invention relates to stringed musical instruments and, more particularly, to a composite material guitar which is acoustically tailored by appropriate selection of composite materials and design to produce a desired appealing tonal quality. It also relates to a method of acoustically tailoring a string instrument by appropriate selection of composite materials and design, to produce a desired tonal quality selected from a broad range of tonal qualities which could be produced.

Many attempts have been made to find materials besides wood from which to fabricate string musical instruments, primarily because of wood's inherent fragility and sensitivity to temperature and humidity. With the dwindling worldwide forests of guitar woods, the need for alternate materials is growing. Composite materials have been used in musical instruments since the 1960s. The potential advantages of composites for musical instruments is widely recognized, and has been written about extensively, including in the "Composite Materials Handbook" (Mel M. Schwartz, 1984, McGraw-Hill, Inc.). Composite materials are inherently more durable and much less sensitive to humidity than wood. A typical wooden guitar top will absorb 10 percent water by weight and grow 0.25" in width due to a humidity change from 35% to 85%, changing the relative position of the strings, the internal stress states (it is not uncommon for wooden guitars to crack or break just due to humidity changes), and the overall response of the guitar.

In summary, composite materials offer an attractive alternative to wood for stringed instruments. The key advantages being (a) stringed instruments made from composite materials typically are more durable, less easily damaged, (b) they are much less sensitive to moisture and humidity, (c) they are stiffer and stronger, can be made thinner and lighter and therefore more responsive, and (d) they inherently are less damped. The fundamental principles discussed above have been known to luthiers (stringed instrument builders) for many years, and people have attempted to take advantage of the potential advantages of composite materials for over 30 years. For example, reference is made to U.S. Pat. Nos. 3,656,395; 3,664,911; 3,699,836; 3,724,312; 3,880,040; 4,145,948; 4,213,370; 4,290,336; 4,969,381; 5,333,527; 5,546,874; and 5,469,769. The struggle has been to produce instruments with both the characteristic sound that musicians demand and all the advantages of composite materials. Previous composite instruments also have been costly.

SUMMARY OF THE INVENTION

It has been found that wood can be completely avoided in a stringed instrument and a sound that is very appealing to musicians and enthusiasts (tonal quality like a traditional wood instrument with better volume, clarity and bass) can be provided by the careful selection of laminates of composite materials for the sound producing components of a guitar or the like. In this connection, the science of laminating composite material layers has reached the point at which combinations can be selected to produce desired sounds.

Material selection and instrument design are the keys to the sound. The characteristic sound made by striking identically shaped wood and metal objects is easily distinguished. Composite materials (high strength fibers embedded in a polymeric matrix) generally sound somewhere between wood and metal when struck. The stiffer the laminate and the higher the fiber content (e.g., a graphite reinforced laminate with 70% carbon by weight), the more it sounds like metal; the lower the stiffness and higher the resin content (e.g., a glass reinforced laminate with 50% glass by weight), the more it sounds like wood. The characteristic sound is, in part, a function of the speed of sound in a particular material, which is directly proportional to the stiffness of the material and inversely proportional to its density.

As alluded to above, it has been discovered as part of this invention that the relative percentage of resin and fiber in a laminate affects the sound. In general, the higher the percentage of resin, the duller the sound, the higher the percentage of fiber, the brighter the sound. The selection of reinforcement fibers also affects sound. Organic fibers like aramid and polyethylene dampen sound and sound more like wood. High carbon fiber laminates ring similar to metal. Glass fiber laminates sound somewhere in between organic and carbon fiber. In addition to manipulating the choice and percentage of fiber and resin, it has also been found as part of this invention that particulate fillers can be employed to further alter the sound response of a composite. Small hollow spheres (microballoons) can be added to dampen sound, and metallic fibers can be added to brighten sound.

Costs are minimized with the instant invention by selecting laminates which are not themselves made of expensive materials, are not themselves made by an expensive process, and do not require the stringed instrument to be made by an expensive process.

This summary is divided into the various sound producing parts of a stringed instrument (except for the strings).

The Soundboard. The soundboard or "top" is a very important contributor to the sound produced by a stringed instrument. Ideally, the soundboard vibrates freely when excited by string vibration to produce a desirable tone. From a physics perspective, there are three key factors which affect vibration response of a flat plate, (a) plate mass, (b) bending stiffness, and (c) the internal damping characteristics of a material (how internal friction converts vibration energy into heat).

For two plates that otherwise have identical properties, the one with more mass will not respond as well to vibration. The mass of a plate, like an instrument soundboard, is a function of the thickness and density. Therefore, stringed instrument soundboards are made as thin as possible—only thick enough to withstand the loads imparted to the top without excessive deflection or structural failure. Material strength and stiffness are the primary parameters affecting the minimum top thickness for a given material. Therefore, to achieve minimum mass, strength, stiffness and density must all be considered in material selection. Since higher strength and stiffness are better, and lower density is better, and all have first order effects, a simple ratio with strength or specific stiffness in the numerator and density in the denominator is a good relative measure of a material's potential as a soundboard. This ratio, called specific strength or specific stiffness, has long been recognized by luthiers (stringed instrument builders) and they have used this parameter to select woods. For example, slow growth spruce has a high specific stiffness for a wood, and is therefore almost exclusively used for better guitar soundboards. However, good quality soundboards are in limited supply and are expensive (over $100 in 1998 for the top alone); therefore, inferior quality woods are used on many production guitars.

It follows if a material like slow growth spruce provides a good soundboard because of its specific stiffness, a material like a carbon reinforced composite with very high specific strength and stiffness seems to be an ideal candidate for stringed instrument tops. The raw materials for such a top have consistent quality and can be purchased for around $30 (1998 dollars) a top, with similar labor required as wood to put the raw materials into a finished top.

From a bending stiffness standpoint, there is a significant advantage. Bending stiffness is a function of thickness to the third power. Because the thickness function is cubed and because a composite can be made thinner, a composite panel has much lower bending stiffness, which allows it to respond to vibration more easily. (The lower bending stiffness is not a significant factor in reacting to bending forces from the strings, since tops are braced to take string bending loads. A composite top is over twice as stiff in plane, but much more responsive to vibration due to its lower mass and much lower bending stiffness.

A third and less quantifiable characteristic of soundboards is the internal sound dampening characteristics of a material. Everyone know the difference between the sound of wood and metal in, for example, wind chimes. Wood has a duller response with less sustain (the time it takes for the sound to dissipate), while metal has a ringing response with more sustain. Composites are typically less dampened and have more sustain than wood, providing a longer, louder response to a given string vibration.

It will be seen from the above that composites provide the mechanical qualities required for soundboards. The problem has been getting the characteristic sound. As mentioned previously, it has been found that with appropriate selection of composite material laminates based on the discussion above, a composite material laminate soundboard can be acoustically tailored to provide the desired characteristic sound.

Instrument Body. The body of a string instrument is less critical to sound than the soundboard. However, the body does affect the sound. The body can resonate in vibration like the top (soundboard)—this resonance can reinforce certain frequencies and dampen others. In wooden guitars, guitar makers have over the years been able to identify the characteristics and types of wood which have certain effects on sound. Rosewoods, for example, have a boomy sound with enhanced bass while a mahogany back will have a crisper tone with better highs. This is presumably because the rosewoods have a 30% lower stiffness to weight ratio than mahogany, and therefore don't respond as well to the higher frequency sounds. Luthiers (stringed instrument makers) often combine specific pieces of wood to produce a desired tone—but are limited to what they can find that Mother Nature has produced. Also, with the body influencing the sound, how a musician holds the instrument, and how much the body is dampened can affect the response—this is especially true of a guitar.

In contrast to traditional wooden instruments, where the body actively contributes to tonal quality, the tonal interaction of the body is minimized in the instant invention. The body of the present invention is analogous to a ported loudspeaker enclosure, wherein the enclosure is designed to have minimal effect on the sound of the speaker system. In a loudspeaker, the speaker (driver) cone creates sound waves both on the front and back surfaces. These sound waves are out of phase, so the lower frequency sound waves (large wavelengths) from the back of the speaker can interact with and cancel the sound waves from the front of the loudspeaker, dramatically reducing volume. The speaker enclosure prevents this from happening. However, if not properly designed, the loudspeaker enclosure can have its own negative impact on sound quality. For optimum response, it is critical that the loudspeaker enclosure have minimal impact on and interaction with the sound reproduction by the speaker cone. Therefore, properly designed loudspeaker enclosures are sufficiently stiff and damped such that they do not vibrate and create sound which is not in the original signal being driven by the speaker cone. Also, the inside surfaces must be damped to minimize magnitude of reflected sound, which can interact with the driver and distort the response. Damping is also required to minimize standing waves (echoes) and increase the rate of sound decay; damping effectively minimizes or eliminates the sustain of sound in the enclosure after the driving input has ceased. In a ported enclosure, the closed volume of air and the port create a Helmholtz resonator, which effectively increases the efficiency of the speaker.

The function of the guitar body of this invention is similar to a loudspeaker enclosure. The top is analogous to the speaker driver creating the sound waves. The body, therefore, is designed to: (a) prevents out-of-phase sound cancellation from the back of the top, (b) have minimal impact on sound due to minimal internal vibration, controlled magnitude of reflected sound, and limited sustain after driving input (string vibration) ceases, and (c) cooperate with the top to effectively create a Helmholtz resonator.

The functions of the Helmholtz resonator and preventing back and side out-of-phase sound cancellation are defined by body shape and sound hole dimensions, and are not unique. The unique feature is the acoustic tailoring of the body material such that it has minimal negative impact on the instrument sound. In composite guitars in particular, the inside surface is typically hard and smooth—preferentially reflecting upper mid range sounds and creating a "tinny" or metallic sound. Ideally, for the prevent invention the surface should be textured and porous, such that incident sound is scattered by the texture and dampened by the vibration of the small masses of air in the porous openings of the surface. This dampening and scattering minimizes the preferential reflection of upper mid range tones. It further minimizes the magnitude of reflected sound and increases the decay of sound in the body cavity itself, thereby minimizing interaction of vibrations occurring in a prior instant with those occurring in a present instant. This effect is very similar to the effect of acoustic tiles and carpets in buildings. With the use of acoustic surfaces, echoes (standing waves) and sound reflection are minimized and the spoken word is much clearer and easier to understand at lower volume levels (e.g., the difference between an empty gymnasium and a well-designed auditorium). In addition to the surface texturing, the body most desirably is stiff and well damped, so as to minimize its response to vibration.

The Neck. It is desirable to make the body and neck as one part to improve overall strength and to minimize assembly costs. To this end, in order to integrate the body and neck, the neck is also made from laminates of composite material, which laminates extend into the body to provide the support required by the neck to maintain the strings in tension.

Other features and advantages of the invention either will become apparent or will be described in connection with the following, more detailed description of preferred embodiments of the invention and variations.

BRIEF DESCRIPTION OF THE DRAWING

With reference to the accompanying sheets of drawings:

FIG. 2 is a longitudinal side sectional view of the guitar of FIG. 1;

FIG. 3 is a plan, somewhat schematic view of the underneath side of the soundboard of the guitar of FIG. 1;

FIG. 4 is a side view of a blade type stiffener of a type utilized in the soundboard of FIG. 3;

Figure 1:
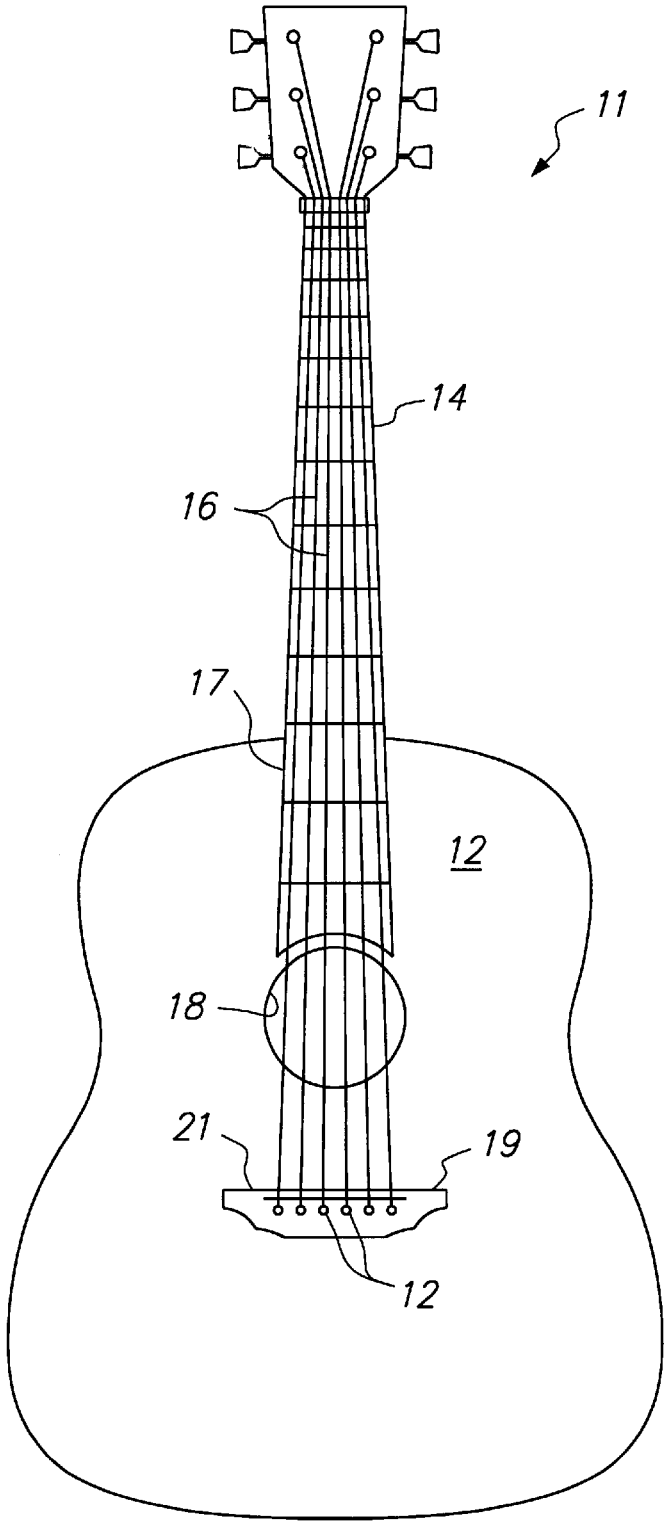
FIG. 1 is a plan view of a guitar incorporating a preferred embodiment of the invention.

Other features and advantages of the invention will become apparent or will be described in connection with the following, more detailed description of a preferred embodiment of the invention.

DETAILED DESCRIPTION OF THE PREFERRED EMBODIMENTS

The following, relatively detailed description is provided to satisfy the patent statutes. It will be appreciated by those skilled in the art, though, that various changes and modifications can be made without departing from the invention.

This invention is a technology for making stringed instruments using advanced composite materials, the novel features of which are listed below:

1. A sound tailorable stringed instrument soundboard made from a high performance laminate material comprised of inorganic fibers, a polymeric resin, and optionally a particulate filler, in thickness and proportions to produce a characteristic sound. The laminate material has a stiffness to density ratio higher than wood, and the soundboard has internal bracing in the form of high stiffness to weight blade type stiffeners. The top of the soundboard has a bridge for attaching strings, which bridge includes a saddle portion on which the strings rest; and one or more layers of a damped laminate are provided under the bridge to reinforce the bridge and attenuate high frequency vibration overtones.
2. A composite guitar body comprised of a back, sides and neck integrally formed together, with selected carbon fiber reinforcement in the neck and neck/body interface region to provide required stiffness and resistance to warpage, with the back and sides containing layers of a hard, stiff laminate to define shape and provide stiffness, the provision of acoustically tailored inside surface to minimize standing waves and the incorporation of a low density, well damped laminate material in the body.

A guitar incorporating the invention is generally referred to in the figures by the reference numeral 11. Such guitar includes a soundboard 12 and a body 13. The guitar further includes a neck 14 which supports one end of musical strings 16. Such strings extend along the neck and body over a fret board 17 (in musical instruments which do not have frets as in a guitar, a finger board is provided in place of such fret board) and over a hole 18 in the soundboard 12 to a bridge 19. The bridge includes both a saddle portion 21 which supports the strings in position, and string end securance pins 22.

The soundboard 12 is optimized for sound performance by (a) material selection, (b) thickness, (c) internal bracing approach, (d) design and material selection at the bridge where string vibration is introduced into the top.

The optimum materials for the basic membrane area of the soundboard vary depending on the characteristic sound desired. The unique principle behind the material formulation is to methodically increase the resin content over what is typically used in the aerospace industry (and in the James and Cumpiano U.S. Pat. No. 5,333,527) to dampen the undesirable overtones, but not to the point where the strength and stiffness advantages of the composite materials is lost. Infinite combinations exist, but the specific ranges believed to be ideal are given in Table 1 below.

TABLE 1

Preferred Formulation Ranges for Composite Materials of Stringed Instrument Tops

| MATERIAL | PERCENTAGE |
|---|---|
| Carbon Fiber | 30 to 50% |
| Glass Fiber | 0 to 20% |
| Resin | 40 to 60% |
| Filler | 0 to 10% |

The carbon fiber is typically a fiber made from a PAN (polyacrylinitrile) precursor, having a modulus from about 30 msi to 45 msi, and a strength from 450 to 900 ksi. This type of carbon fiber is widely available from many manufacturers. The glass fiber may be either "E" glass or "S" glass. It will be seen from the above that organic fibers, such as taught in the Decker, Jr. et al. U.S. Pat. No. 4,969,381 are not preferred. Organic fibers are avoided because (a) it is difficult to get good fiber to resin bonds with organic fibers; (b) their tendency to absorb significant weight percentage of water (particularly aramid fibers); and (c) their tendency to creep under load (particularly polyethylene fibers). These factors can negatively affect long-term durability and sound quality.

The preferred resin is epoxy, although polyester, vinyl ester, phenolic, or other resin systems may be used. Two specific formulations that have been shown to produce outstanding sound are shown below.

TABLE 2

Specific Formulations

| MATERIAL | FORMULATION 1 (weight %) | FORMULATION 2 (weight %) |
|---|---|---|
| Carbon Fiber | 50% | 45% |
| Glass Fiber | 0% | 5% |
| Resin | 50% | 50% |

Another advantage of the use of laminates with resin contents in the 40% to 60% range is that such laminates can be fabricated without expensive equipment. To consistently achieve lower resin contents, composite material industries typically use expensive materials and manufacturing equipment, such as presses or autoclaves, to apply pressure to the laminates during cure. With the invention, simple hand lay-up techniques with or without vacuum bag pressure are all that is required, although the desired end product may be produced by a number of manufacturing methods. The use of hand lay-up techniques allows implementation of the claimed technology into a manufacturing operation with minimal capital equipment requirements and lower raw material costs.

The use of fillers has been shown in test panels to have the potential to modify the sound. In particular, addition of a small percentage of glass, phenolic, or other microballoons (very small spheres) can effectively dampen certain frequencies without significantly affecting the overall response of the top.

The selection of top thickness is also an important parameter. Ideally, the top must weigh less than a comparable wooden top, while having the same or higher strength and inplane stiffness, and lower bending stiffness. To accomplish this the top should be between 0.020 and 0.060" thick, preferably between about 0.035 to 0.045" thick.

Internal bracing of the instrument top is provided to resist the string forces. Such bracing also affects the sound of the guitar. For optimum performance, the braces should be stiff, but have minimum weight. With this in mind, the preferred embodiment includes a "blade" type stiffener 23. A thin, but very stiff blade is a very efficient way to reinforce the top without adding much mass. In the preferred embodiment, the blade has a length of approximately 0.6 inches. It includes a tail 24 for securing the same to the underneath side of the soundboard, which tail in the preferred embodiment has a length of approximately 0.2 inches. The "pattern" of placement of the stiffeners 23 on the underneath side of the soundboard is illustrated in FIG. 3, although the stiffeners themselves are not shown in detail so as to avoid unneeded drawing complexity. This pattern is conventional. Although not depicted in the drawing because the blade is so thin, the stiffener is actually made up of five composite layers. The two exterior layers are both 6 ounce fiberglass fabric With another ply of 6 ounce fiberglass sandwiched between two three-ounce carbon tape plies having unidirectional carbon. The use of unidirectional carbon fiber layered between layers of glass fabric produces a blade stiffener which is very stiff, but does not produce the high frequency overtones of an all carbon fiber reinforced stiffener.

Figure 7:
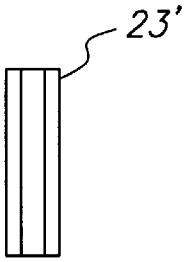
FIG. 7 is a side view similar to FIG. 4 showing an alternate reinforcement strip.

The use of damped blade stiffeners in combination with the high stiffness top provide a minimum weight top, the major portions of which vibrate freely with little input energy, but which is still stiff and strong enough to withstand the string loads. FIG. 7 shows alternate configuration for the stiffener. The stiffener 23 uses a low density foam core between two carbon fiber laminates.

The underneath side of the soundboard also includes, as is common, reinforcement pieces 25 for the hole 19. The positioning of these reinforcement pieces is conventional in that their thickness and ply arrangements are the same for the full soundboard.

The construction of the stringed instrument bridge 21, or piece which rests on the top on which the strings rest, is important to the sound response. The particular design of the bridge of a violin, a thin piece of wood with carved openings, has been studied and experimented with for centuries. Changing shape, size, and location of the holes in the bridge affect sound. Presumably, the complex design, though not very well understood scientifically, allows the transmission of string vibration with the proper balance of frequencies. It follows that altering the bridge design will emphasizes or diminish certain frequencies and not produce the desired sound.

In acoustic guitars, such as in the preferred embodiment, the bridge design is far less complex, and material selection is more the typical factor which guitarists and luthiers vary. An acoustic guitar bridge is typically a piece of wood bonded to the top of a guitar, with holes and pins for attaching strings, and a saddle which the strings rest on and through which the sound vibration is transmitted to the top. The saddle is the primary variable most guitarists and luthiers vary. Bone is widely perceived as the best material for a saddle; however, the vast majority of guitars have some sort of plastic or polymeric saddle. Ivory has been used, as well as graphite epoxy laminates. Graphite epoxy saddles have been sold commercially and materials for making them are available from guitar supply stores. Beyond the saddle, various woods (particularly ebony and rosewood) and even graphite/epoxy have been used for the bridge itself, and completed bridges made from these materials are commercially available. In the preferred arrangement the bridge is a piece of wood bonded to the soundboard, which piece of wood supports a composite saddle. The composite laminate saddle has been specifically tailored for optimum vibration transfer. The laminate has carbon fibers running in the direction from the strings to the soundboard, and a low content of glass fibers (approximately 20 percent of the carbon) running transverse to the carbon fibers. This allows very efficient sound transfer into the soundboard and minimal string vibration damping at the bridge/string interface. This arrangement also minimizes vibration transfer between strings, so as to minimize "crosstalk," or vibration transfer between strings. The configuration takes advantage of the principle that carbon fiber laminates transfer vibration very efficiently in the direction of the fiber, and poorly in the direction transverse to the fiber.

As a particularly important aspect of the invention, the material underneath the bridge is tailored to acoustically attenuate the vibration response of the instrument. The problem with carbon/epoxy tops is not the reproduction of the fundamental frequencies of a stringed instrument (75 to 900 Hz), it is in the overtones and harmonics of the top (vibrations at frequencies different from the fundamental input frequency). Without going in to a long discussion of overtones and harmonics, suffice it to say that a typical carbon/epoxy top will produce more high frequency overtones than a comparable wooden top, resulting in a nasal, tinny, or metallic sound. The approach taken by others has been to globally dampen the guitar top by the addition of dampening fibers (Decker, Decker and Halford in U.S. Pat. No. 4,969,381) or using wood (Kaman in U.S. Pat. No. 3,880,040). While the use of soundboards having the resin and fiber portions described earlier provide an efficiently damped composite for some applications, additional damping is necessary in others to achieve a sound comparable to wood. The novel approach incorporated by this invention is to locally dampen the unwanted frequencies at the bridge. This approach creates the desired sound without having to increase damping of the entire top, thereby maintaining the superior vibration response. The high frequency overtones originate at the vibration source and propagate outward primarily by short wavelength oscillations. Having a material under the bridge that absorbs and doesn't transmit these frequencies very well dampens them quickly. The lower more desirable frequencies excite more global plate responses of the guitar top and are only minimally affected by the local dampening effect of the bridge attenuation material.

Many materials may be used for the bridge reinforcement to accomplish the desired effect. A glass epoxy laminate with a resin content of 40 to 60% by weight works very well and is incorporated in the present invention as shown at 26 in FIG. 3. This laminate can be tailored by varying the type of fiber and the ratio of fiber to resin, to create a desired response. The ability to vary tonal quality by varying the laminate under the bridge has been demonstrated by the fabrication of guitars with distinctive tonal qualities. Guitars have been fabricated with a "bright" tonal quality for finger picking (where the method of playing naturally produces mellow sounds), and a more mellow guitar for flat picking style, where the method of playing naturally produces a bright tone.

This principle for providing acoustic tailoring under the bridge may also be applied to the bridge itself.

A key innovative feature of the guitar body is the materials selection and construction to produce a highly desirable tone while minimizing or eliminating the mid- to high frequency overtones characteristic of composite guitars. The body consists of outer layers of traditional glass or carbon reinforced laminates with an inner layer(s) specifically tailored to produce a desired characteristic sound.

Figure 5:
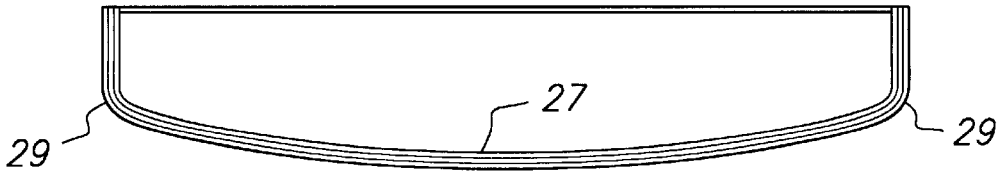
FIG. 5 is an end sectional view of the resonant cavity of the guitar of the preferred embodiment.
Figure 6A:
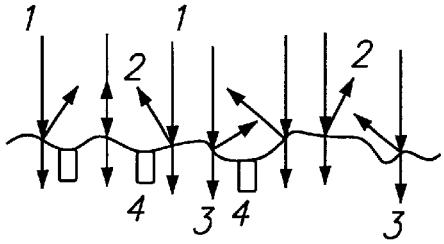
FIGS. 6A and 6B are enlarged schematic illustrations of sound waves respectively impinging on a acoustically tailored surface within the body of the guitar of the invention, and sound waves impinging on the typical interior surface found in most non-wood guitar cavities.
Figure 6B:
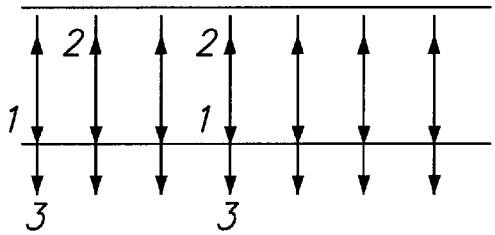

The acoustic tailoring of the main cavity of the body is important for producing the desired response. The two key components are (a) the acoustic texturing of the inner surface of the body, and (b) the inclusion of a well damped with poor sound transmission characteristics in the body. FIGS. 5 and 6 show the difference in sound reflection between a hard smooth surface and an acoustically tailored surface. With the hard smooth surface (FIG. 6B), a significant portion of the incident sound energy is reflected normal to the direction of the incident sound waves. This sound can be reflected back and forth between the instrument top and back many times, creating standing waves that sustain longer than the string induced tone, and interfere with or color the instrument tonal response. Standing waves can be set-up in a musical instrument at frequencies for which the distance between the opposite surfaces of the instrument is equal to a positive integer multiple of one wavelength. For a guitar, single amplitude standing waves can be established between the top and bottom of the instrument in the frequency range of 2500 to 4500 Hz, corresponding to wavelength (and guitar body depths) of 3" to 5.5". These frequencies are of particular concern because if they are predominant in the frequency response, they can give an instrument a nasal or tinny sound. Any musical device with peaks in the frequency response in the upper midrange (~1500 to 5000 Hz) sounds nasal and tinny, and is typically thought of as "cheap" and undesirable, like an inexpensive transistor radio with a small speaker. Therefore standing waves in the upper midrange should be minimized to avoid disproportionate reinforcement of sound in these frequencies and the negative effects associated therewith.

On the other hand, an acoustically engineered surface in accordance with the invention (FIG. 6A) (a) reflects sound at oblique angles in many different directions, scattering and dissipating incident energy, and (b) absorbs more of the incident energy due to its low density and high damping characteristics. The bottom line is that there is a clean, clear amplification of the transient string response (due to the Helmholtz resonator effect) without a lot of coloration from sound bouncing around inside the instrument body.

There are several ways to achieve the desired material characteristics for the guitar body. The preferred approach is to use a material for the inner layer which contains multiple tiny pores and has a rough, textured surface; the pores provide the damping and the textured surface provide the proper acoustic sound reflection. This type of surface is especially effective in absorbing sound in the 2500–4000 Hz frequency range, and is therefore effective against the negative coloration discussed previously. Such an inner layer 27 is shown in the drawings. One method to create such an inner layer is to mix microballoons with the resin and laminate a open weave, heavily textured carbon or glass fabric with the resin/microballoon mixture. The preferred method at this point is to laminate as the inner layer of the guitar, a type of core material widely used in the boat building industry consisting of a thermoplastic microballoons trapped in a thin polyester veil. This material can be impregnated with resin and laid up at the same time as the outer laminate layers. It conforms to the guitar body during fabrication.

The inclusion of an open or closed cell foam as the inner layer will also serve the same purpose, provided it is not so thick and flexible that it dampens too much sound.

Other key features are the integration of the neck to the body and the contoured shape of the body. The method of integrating the neck to the body is to continue the reinforcing plies of the neck through a small radius into the inside of the guitar, down the side of the guitar, and terminating them in the back of the guitar body, as shown at 28 in FIG. 2. Carbon fiber is used as required to achieve the desired stiffness to resist the string tension, and the central portion of the neck may include a low density core (foam, resin filled with microballoons, etc.) to minimize weight and reduce costs.

The integration of the neck to the body simplifies manufacturing and reduces costs and assembly operations without sacrificing performance. The integration of the neck into the body is innovative in that the design allows the neck to intersect the body without any external reinforcement, which is common with most guitars—even other composite guitars. This allows the guitarist to play further on the neck without interference. This feature also simplifies the mold in which the integral neck/body are fabricated.

The shape of the body is contoured for playability. The guitar back is curved to fit nicely to the human body in the typical playing position, and the corners are rounded to eliminate the sharp corners 29 which provide discomfort for guitarists when playing in the seated position. This improvement is very appealing to most guitarists. For other instruments, the rounded corners are less easily damaged than square corners.

In the preferred configuration, multiple layers are combined to construct the guitar body. The outer layers are carbon and/or glass reinforced laminates, with 40 to 60% resin by weight, and an inner layer or layers of an acoustically tailored, well damped material. Also laminates are used to reinforce selected areas on the inside of the guitar. An additional ply of carbon fabric laminate is added to the sides of the upper body to help minimize body deflection from the forces of the nick, and a 2-inch wide carbon fabric strip is added across the widest part of the back to add stiffness. The construction can be accomplished without special fabrication equipment (presses or autoclaves), wet lay-up with dry reinforcement and liquid resin is sufficient.

Because of the design approach, the back can be coated in virtually any method to produce a cosmetically pleasing surface. While on wooden guitars, the thickness and type of finish must be minimized to prevent damping of the critical vibrations, while with the claimed invention, vibration of the back is not desired in the preferred embodiment critical element of the instrument performance and therefore coating thickness and mass are much less important.

The method of assembly of a guitar using the components discussed above is very similar to traditional guitar building, with a notable exception that the neck and back are integral and do not require assembly. The stiffeners are bonded to the soundboard using preferably epoxy adhesive and contact pressure. The bridge reinforcement is laid up onto the stiffened top using dry fabric and resin and allowed to cure. The assembled top is bonded to the integral neck/body using preferably epoxy adhesive and contact pressure. The remainder of the guitar assembly (attaching bridge, fretboard, tuners, etc.) is typical of traditional guitar making.

Materials from any supplier which meet the basic requirements defined previously should work equally as well. The particular weaves of the carbon and glass fabrics are not critical as well. From a materials standpoint, what is important to the preferred embodiment is (a) the use of carbon fiber in the top, top braces, and neck of the guitar, (b) the ratio of fiber to resin in the top, (c) the use of a relatively resin rich glass fiber reinforced laminate under the bridge, and (d) the use of a textured surface for the inside body of the instrument. However, the following description of a specific implementation is given to facilitate duplication of the instant invention. The following is a description of a specific implementation of the instant invention. The description of the make-up of the various laminates providing the various parts of the guitar, is proceeded by a key providing details of the various elements which are identified in the description.

Detailed Laminated Descriptions 5.6 oz. Bi-directional Carbon Fabric:

Fiber. Pan based carbon fiber (e.g., T-300 made by Amoco Corporation or AS4 manufactured by Hexcel Corporation, Inc.) in bundles (tows) of 3000 filaments.

Weave. Plain weave with a fiber bundle spacing of approximately 12 bundles per inch in each direction (12 bundles per inch in warp, or longitudinal direction of fabric and 12 bundles per inch in fill direction, or transverse direction of fabric).

Fabric Weight. Approximately 5.7 oz/yd$^2$ 4.7 oz. Uni-directional Carbon Fabric:

Fibers. Pan based carbon fiber (e.g., T-300 made by Amoco Corporation or AS4 manufactured by Hexcel Corporation, Inc.) in bundles (tows) of 3000 filaments, and S-glass.

Weave. Plain weave with a fiber bundle spacing of approximately 16 bundles per inch carbon fiber in warp or longitudinal direction of fabric, and 16 bundles glass fiber per inch in fill or transverse direction of fabric.)

Fabric Weight. Approximately 4.7 oz/yd$^2$ 3 oz. Uni-directional Carbon Tape:

Fiber. Pan based carbon fiber (e.g., T-300 by Amoco Corporation or AS4 manufactured by Hexcel Corporation., Inc.) in bundles (tows) of 3000 filaments.

Construction. "Heat-Tac" tape in which fiber bundles are flattened and held together by a fine thermoplastic polymer coating.

Tape Weight. Approximately 3 oz/yd$^2$

Resin:

Two part liquid epoxy resin/hardener system (Pro Set 125 resin mixed with Pro Set 226 or Pro Set 229 hardener manufactured by Gougeon Brothers, Inc.) at a ratio of 3 parts resin with 1 part hardener.

6 oz. Glass Fabric:

Fiber. E-glass.

Weave. Style 3733 plain weave, 18 threads per inch in each direction.

Fabric Weight. 6 oz/yd$^3$ 2.3 oz. Glass Fabric:

Fiber. E-glass

Weave. Style 2113 plain weave, 60 threads per inch in warp direction and 56 threads per inch in fill direction.

Fabric Weight. 2.3 oz/yd$^3$

Microsphere Filled Mat:

Coremat XX, 4 mm thickness, a plastic microspheres embedded in a non-woven mat.

Top of Soundboard Description:

| Ply Number | Reinforcement | Percent Resin | Comment |
|---|---|---|---|
| 1 | 5.7 oz Carbon Fabric | 45 to 55 | |
| 2 | 5.7 oz Carbon Fabric | 45 to 55 | |
| 3 | 5.7 oz Carbon Fabric | 45 to 55 | |
| 4 | 5.7 oz Carbon Fabric | 45 to 55 | |
| 5 | 6 oz. Carbon Fabric | 55 to 65 | Bridge reinforcement area only. |
| 6 | 6 oz. Carbon Fabric | 55 to 65 | Bridge reinforcement area only. |
| 7 | 6 oz. Carbon Fabric | 55 to 65 | Bridge reinforcement area only. |
| 8 | 6 oz. Carbon Fabric | 55 to 65 | Bridge reinforcement area only. |

Body Laminate:

| Ply Number | Reinforcement | Percent Resin | Comment |
|---|---|---|---|
| 1 | 2.3 oz. Glass Fabric | 55 to 65 | |
| 2 | 5.7 oz Carbon Fabric | 55 to 65 | |
| 3 | 5.7 oz Carbon Fabric | 55 to 65 | Upper body region only |
| 4 | 4 mm Microsphere filled mat | 40 | |
| 5 | 5.7 oz. Carbon Fabric | 55 to 65 | Upper body region only |

Neck Laminate:

| Ply Number | Reinforcement | Percent Resin | Comment |
|---|---|---|---|
| 1 | 2.3 oz Glass Fabric | 55 to 65 | |
| 2 | 20 oz Carbon Fabric | 55 to 65 | |
| 3 | 20 oz Carbon Fabric | 55 to 65 | |
| 4 | 20 oz Carbon Fabric | 55 to 65 | |
| 5 | 4 mm Microsphere filled mat | 40 | |
| 6 | 4 mm Microsphere filled mat | 40 | |
| 7 | 20 oz Carbon Fabric | 55 to 65 | |
| 8 | 20 oz Carbon Fabric | 55 to 65 | |
| 9 | 20 oz Carbon Fabric | 55 to 65 | |

Top Brace Laminate 23:

| Ply Number | Reinforcement | Percent Resin | Comment |
|---|---|---|---|
| 1 | 6 oz. Glass Fabric | 45 to 55 | |
| 2 | 3 oz Unidirectional Carbon tape | 45 to 65 | |
| 3 | 6 oz. Glass Fabric | 45 to 55 | |
| 4 | 3 oz Unidirectional Carbon tape | 45 to 65 | |
| 5 | 6 oz. Glass Fabric | 45 to 55 | |

Top Brace Laminate 23':

| Ply Number | Reinforcement | Percent Resin | Comment |
|---|---|---|---|
| 1 | 4.7 oz. Unidirectional Carbon Fabric | 45 to 55 | |
| 2 | 4.7 oz. Unidirectional Carbon Fabric | 45 to 55 | |
| 3 | "Spyder" Thermoplastic foam | N/A | |
| 4 | 4.7 oz. Unidirectional Carbon Fabric | 45 to 55 | |
| 5 | 4.7 oz. Unidirectional Carbon Fabric | 45 to 55 | |

Saddle Laminate 21:

| Ply Number | Reinforcement | Percent Resin | Comment |
|---|---|---|---|
| 1–12 | 4.7 oz. Unidirectional Carbon Fabric | 45 to 55 | |

Figure 8:
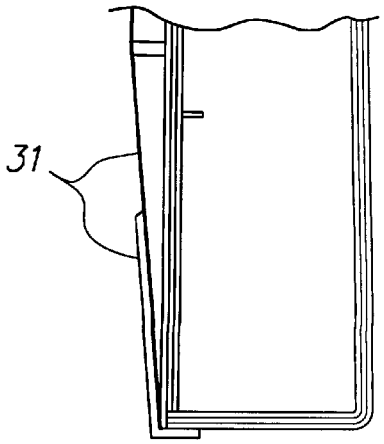
FIG. 8 is a partial sectional view showing a portion of a musical stringed instrument illustrating another alternate construction by which the ends of the musical strings may be secured to the body of a stringed instrument incorporating the invention.

FIG. 8 is included simply to emphasize that the invention is applicable to other musical stringed instruments. It shows a string and securance bridge 31 of the type typically found on violins, etc. As mentioned at the beginning of the detailed description, applicant is not limited to the specific embodiment and variations described above. They are exemplary, rather than exhaustive. The claims, their equivalents and their equivalent language define the scope of protection.

What is claimed is:

1. In a stringed musical instrument, the combination comprising:

A. a plurality of musical strings, each of which has a vibration section for defining a musical tone; and B. a soundboard positioned to interact with the string vibration sections to enhance musical tones produced by vibration of said string sections, said soundboard being made of a plurality of composite material laminates comprised of one or more fibers and a polymeric resin with all fibers in said laminate being inorganic, at least one of said laminates including particulate matter defining a filler to color the response of said soundboard to sound vibrations.

2. In a stringed musical instrument, the combination comprising:

A. a plurality of musical strings, each of which has a vibration section for defining a musical tone; and B. a soundboard positioned to interact with the string vibration sections to enhance musical tones produced by vibration of said string sections, said soundboard being made of a plurality of composite material laminates comprised of one or more fibers and a polymeric resin with all fibers in said laminate being inorganic, each of said laminates being comprised of essentially between 40 and 60 percent resin, essentially between 0 and 10 percent filler, essentially between 30 and 50 percent carbon fibers, and essentially between 0 and 20 percent glass fibers.

3. The stringed musical instrument of claim 2 wherein at least some of said laminates are made essentially of 50 percent resin and a fiber selected from the group of 50 percent carbon fibers and 45 percent carbon fibers with about 5 percent glass fibers.

4. The stringed musical instrument of claim 2 wherein the majority of said soundboard has a thickness in the range of between essentially 0.02 inches and 0.06 inches.

5. The stringed musical instrument of claim 4 wherein said soundboard has a thickness of between essentially 0.03 and 0.05 inches.

6. The string musical instrument of claim 2 wherein said soundboard is generally planer with said plurality of said strings on one side thereof, and one or more blade stiffeners project outwardly from selected locations on the opposite side thereof.

7. The string musical instrument of claim 2 wherein said soundboard is generally planer with said strings on one side thereof passing over a bridge saddle and one or more additional laminates of a composite material are provided on the side thereof opposite said bridge saddle to reinforce the said soundboard at said bridge saddle.

8. The stringed musical instrument of claim 7 wherein at least one of said additional laminates is selected to dampen high frequency overtones produced at said bridge.

9. In a stringed musical instrument, the combination comprising:

A. a plurality of musical strings, each of which has a vibration section for defining a musical tone; and B. a sound resonator positioned and configured to receive vibrations indicative of said musical tone, said resonator having at least two resonator defining surfaces selected to minimize the production of standing sound waves thereat.

10. The stringed musical instrument of claim 9 wherein at least one of said resonator defining surfaces is textured to scatter sound waves which are reflected therefrom.

11. The stringed musical instrument of claim 9 wherein at least one of said resonator defining surfaces is porous to dampen sound waves impinging thereon.

12. The string musical instrument of claim 9 wherein at least one of said resonator defining surfaces has a density at such surface of between essentially 10 and 50 lbs/ft$^3$.

13. In a string musical instrument, the combination comprising:

A. a plurality of musical strings, each of which has a vibration section for defining a musical tone;

B. a body positioned to interact with the vibration sections of said strings to produce musical sounds, and a neck extending from said body to which said strings are secured and maintained in tension at said vibration sections, said neck including a plurality of composite laminate materials at one end that extend into said body to integrate said neck into said body and provide the support required by said neck to maintain said strings in tension; and C. a soundboard which receives musical tones from said strings and passes them on to a resonator defined at least partially by said body, which resonator includes at least a side wall and said plurality of composite laminates at said end of said neck extend into said resonator and along the interior surface of said side wall.

14. The stringed musical instrument of claim 13 wherein to enhance musical tones produced by vibration of said string sections, said soundboard is also made of a plurality of composite material laminates.

15. In a stringed musical instrument, the combination comprising:

A. a plurality of musical strings, each of which has a vibration section for defining a musical line;

B. a generally planar soundboard positioned to interact with the string vibration sections to enhance musical tones produced by vibration of said string sections; said strings being on one side of said soundboard; and C. a plurality of blade stiffeners projecting outwardly from selected locations on the side of said generally planar soundboard opposite the side thereof having said strings, each of said blade stiffeners comprised of a sandwich construction with a central ply sandwiched between plies having unidirectional inorganic fibers.

* * * * *